US006244313B1

(12) United States Patent
Sarvela

(10) Patent No.: US 6,244,313 B1
(45) Date of Patent: Jun. 12, 2001

(54) METHOD AND DEVICES FOR SPLITTING WOOD

(76) Inventor: Juhani Vilho Sarvela, Harjuvlita 2 A 8, Fin-02110 Espoo (FI)

( * ) Notice: Subject to any disclaimer, the term of this patent is extended or adjusted under 35 U.S.C. 154(b) by 0 days.

(21) Appl. No.: 09/403,658

(22) PCT Filed: Apr. 27, 1998

(86) PCT No.: PCT/FI98/00366

§ 371 Date: Oct. 21, 1999

§ 102(e) Date: Oct. 21, 1999

(87) PCT Pub. No.: WO98/48988

PCT Pub. Date: Nov. 5, 1998

(30) Foreign Application Priority Data

Apr. 29, 1997 (FI) ..... 971824
Jul. 9, 1997 (FI) ..... 970324

(51) Int. Cl.[7] ..... B27L 7/00

(52) U.S. Cl. ..... 144/366; 144/193.1; 144/329; 269/130; 248/172; 248/310

(58) Field of Search ..... 144/193.1, 195.6, 144/366, 329; 269/130, 287, 288, 254.12; 248/172, 310, 253, 519

(56) References Cited

U.S. PATENT DOCUMENTS

| | | | | |
|---|---|---|---|---|
| 4,326,703 | | 4/1982 | Marley . | |
| 4,505,465 | * | 3/1985 | McCrary | 144/366 |
| 4,515,195 | * | 5/1985 | Gladstein | 144/366 |
| 4,667,714 | * | 5/1987 | Knutsen | 269/130 |
| 4,756,351 | * | 7/1988 | Knutsen | 269/130 |

FOREIGN PATENT DOCUMENTS 383707 10/1923 (DE) .

* cited by examiner

*Primary Examiner*—W. Donald Bray
(74) *Attorney, Agent, or Firm*—Skinner and Associates

(57) ABSTRACT

The invention concerns a method and accessory for splitting wood. The logs are loaded into a ring (2) to essentially fill it and, if desired, are compressed into a tightly packed bundle, splitting taking place using an impact-bar type device.

18 Claims, 10 Drawing Sheets

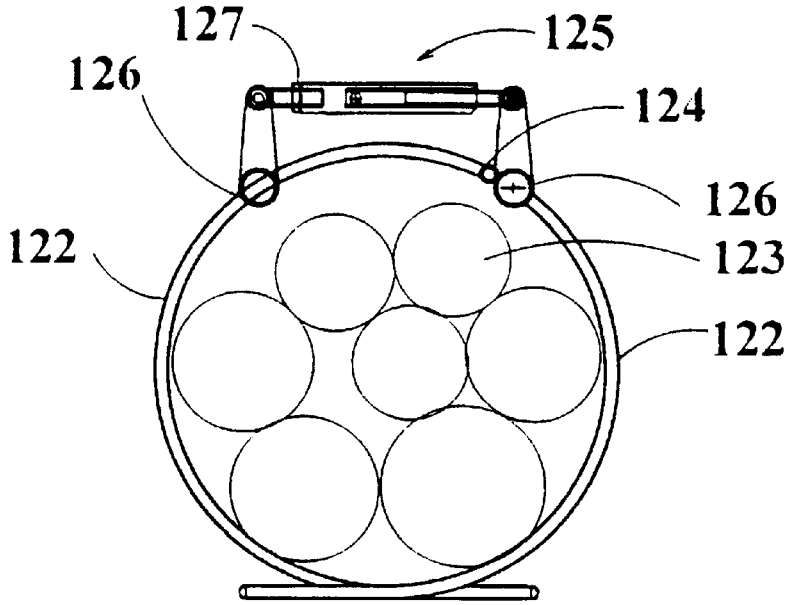
FIG. 2a
FIG. 2b
FIG. 2c
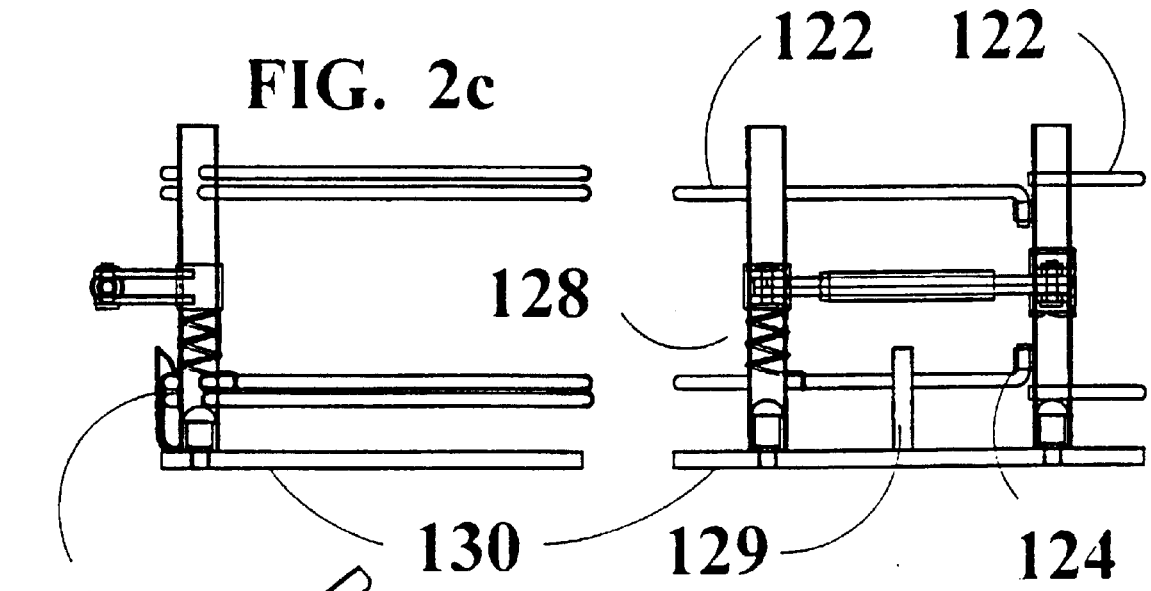
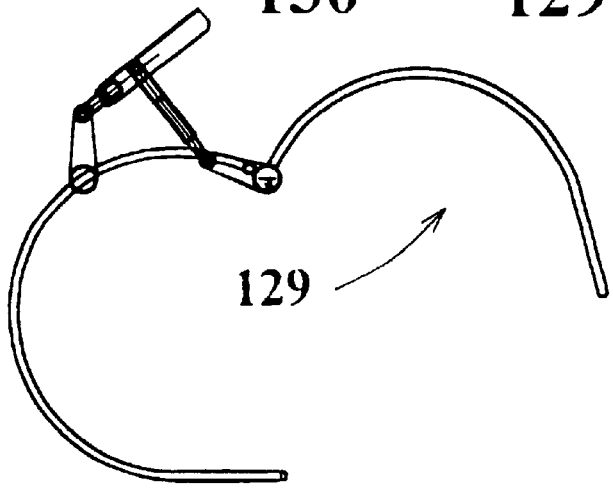
FIG. 2d

METHOD AND DEVICES FOR SPLITTING WOOD

This invention relates to a method and devices for splitting wood and in particular for splitting relatively short pieces of wood into smaller pieces.

Traditionally, wood burned in domestic households, for example wood used in fireplaces, has been split using a suitable base, like a short length of log stood on end, and an axe. As an axe is a fairly dangerous tool in unaccustomed hands, other splitting devices have been developed, such as so-called wedge-axes, the principle of which involves a bar-like construction, splits the wood when an impact bar is propelled linearly. This decisively reduces the risk of accidents.

It is obvious that, although a splitting device with an impact bar is very handy for splitting wood, there is a danger, especially when splitting small diameter wood, of the wood slipping to the side, particularly if the end of the wood has been sawn at an angle, or if the surface of the base slants. When splitting with either an axe or an impact-bar type device, the pieces of wood always have to be transferred to a pile or other place, an operation nearly always involving collection by hand.

This invention is intended to eliminate the drawbacks described above and even to utilize material that would otherwise go to waste. It is also intended to further improve safety and to create a device, which will eliminate the individual handling of the separate pieces of wood to be split. This avoids the problems due to pieces of wood not remaining in place.

These and other advantages and benefits of this invention are achieved by means of the method and devices with the characteristic features described in the accompanying claims. The primary intention is to permit wood to be split easily, safely and rapidly. A further intention is, in the best case, to create a method and device also permitting the easy and safe transfer of split wood from one place to another and possibly its bundling.

Figure 1B:
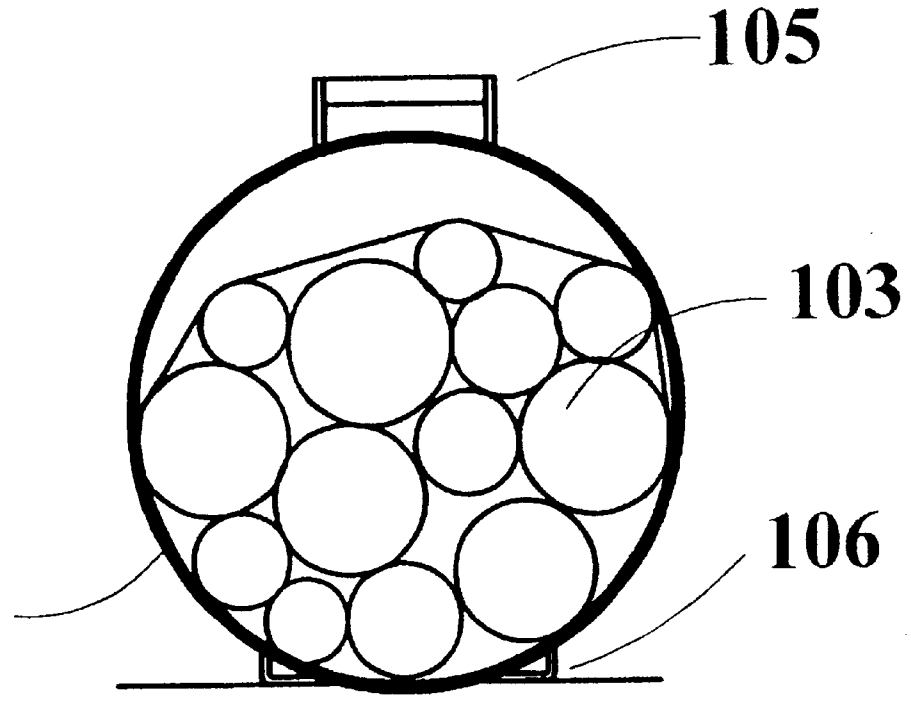
Figure 1A:
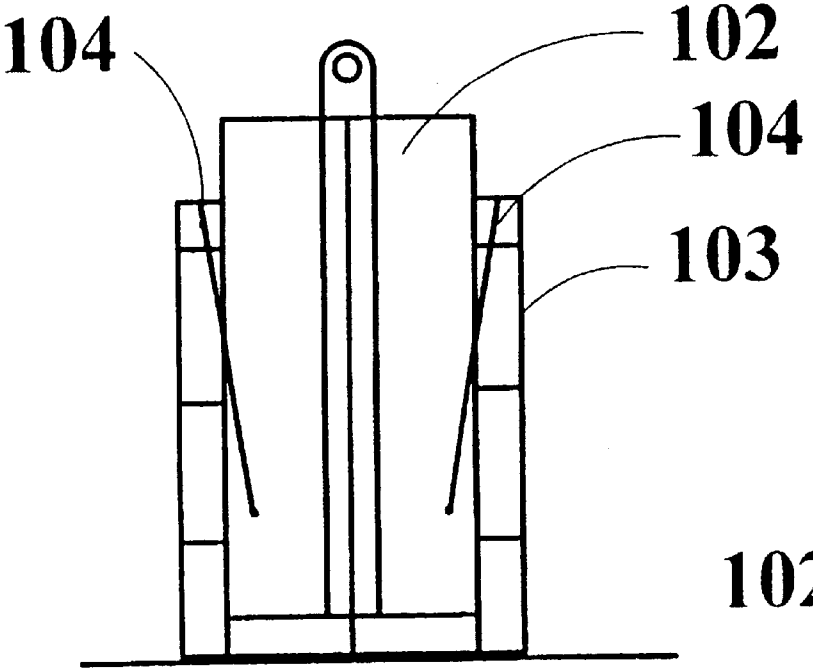
Figures 3A, 3B:
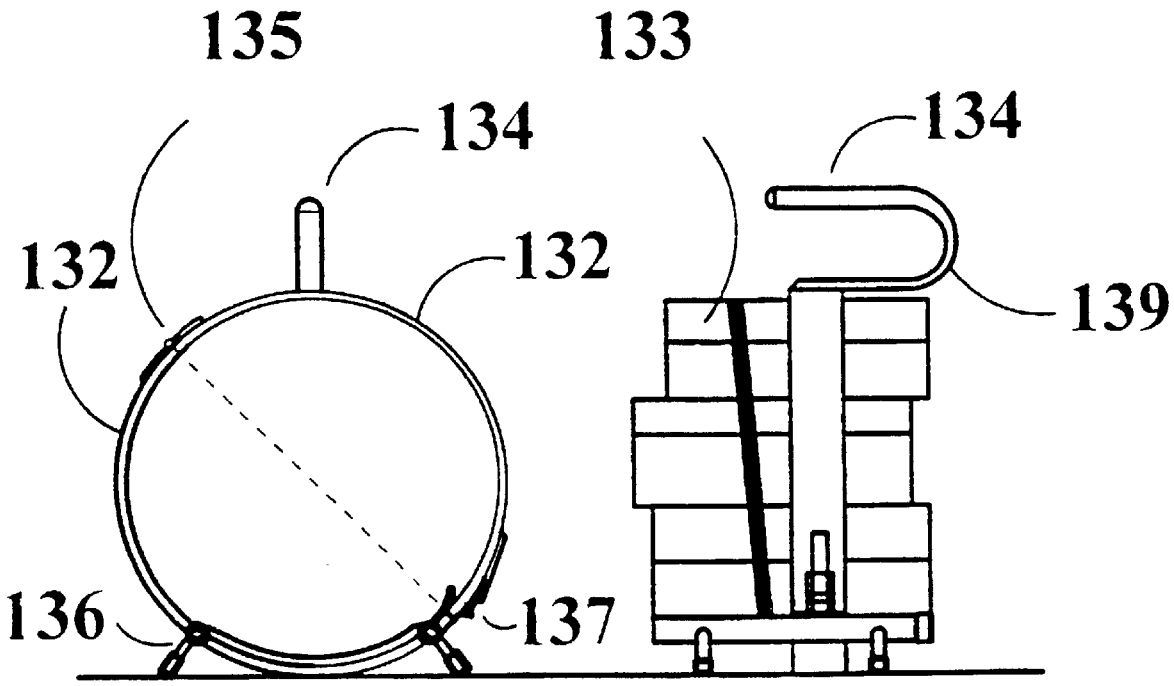
Figures 3C, 3D:
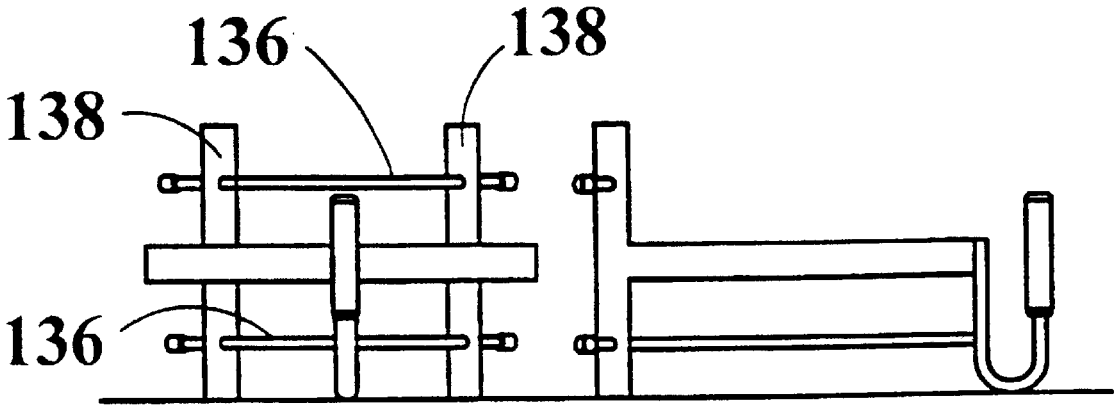
Figure 4A:
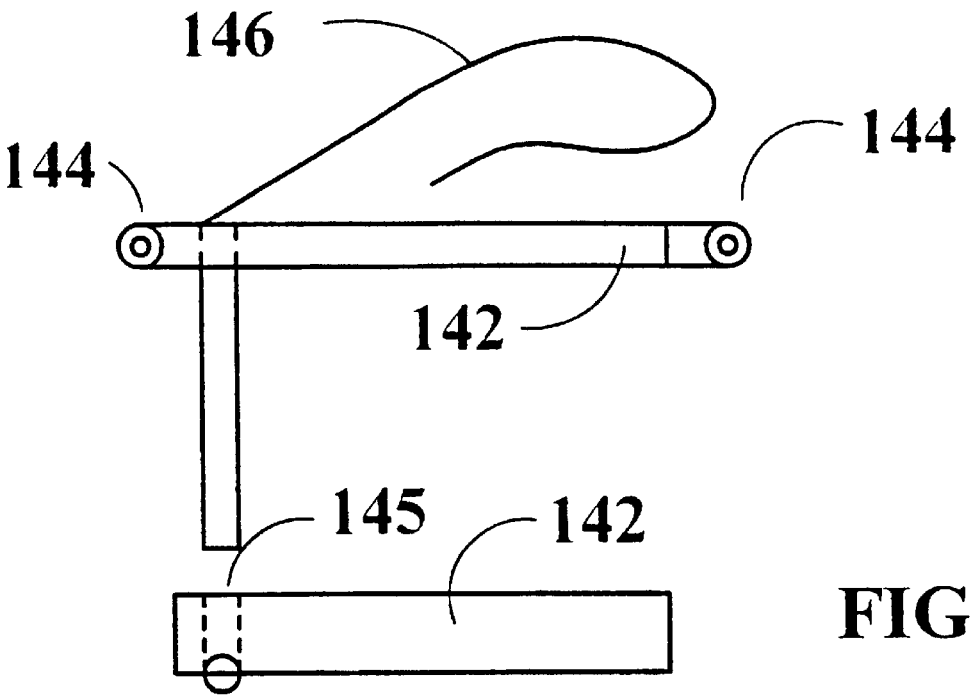
Figure 4B:
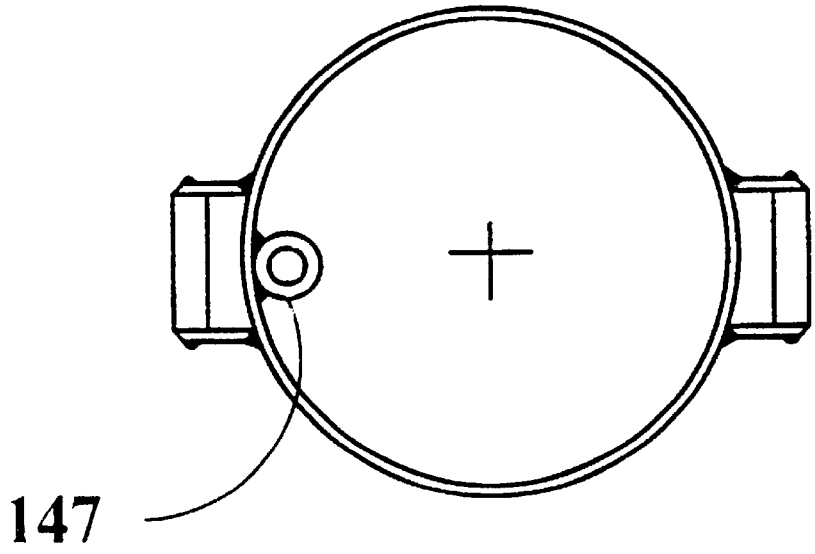
Figure 4C:
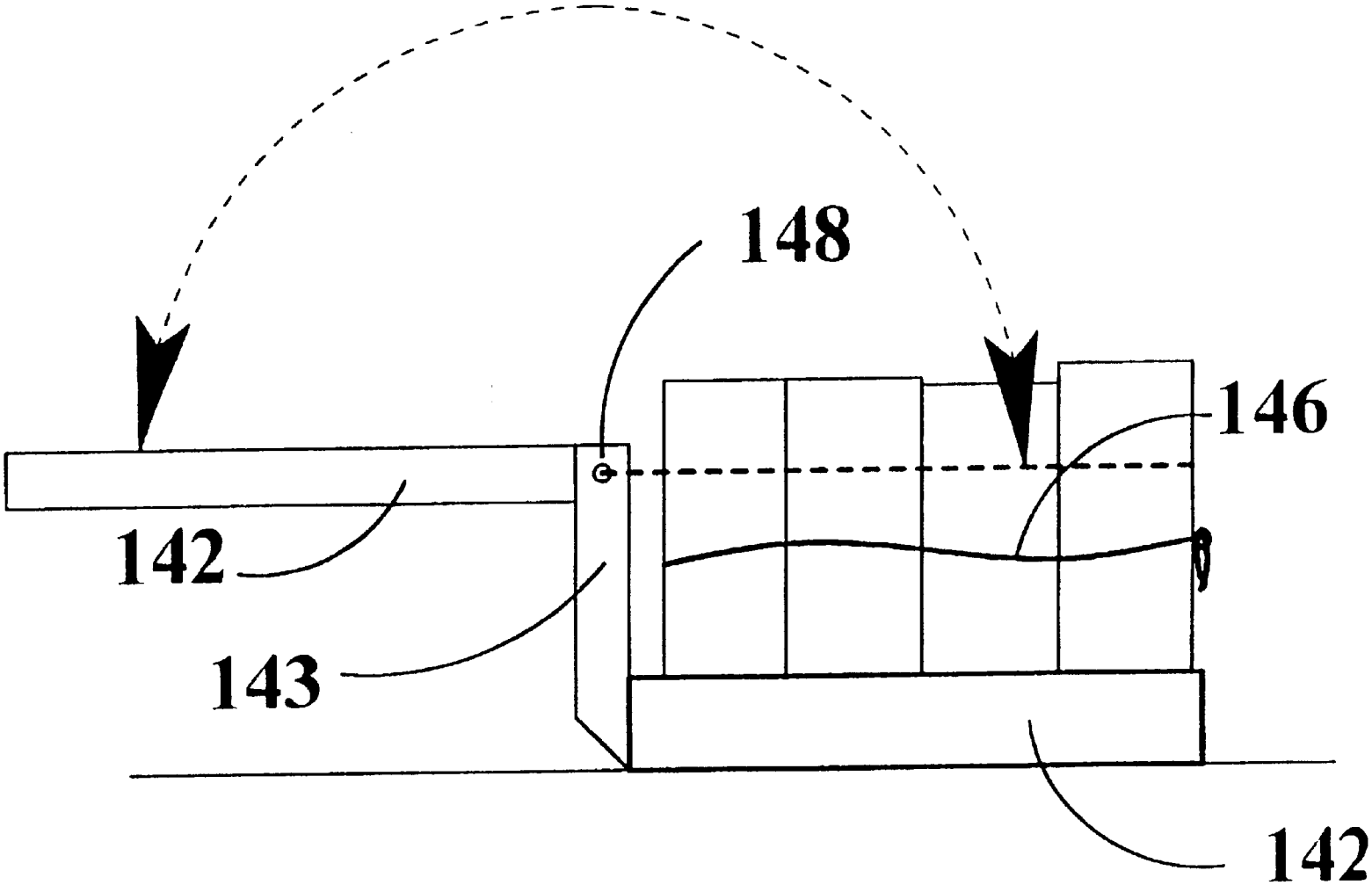
Figure 5A:
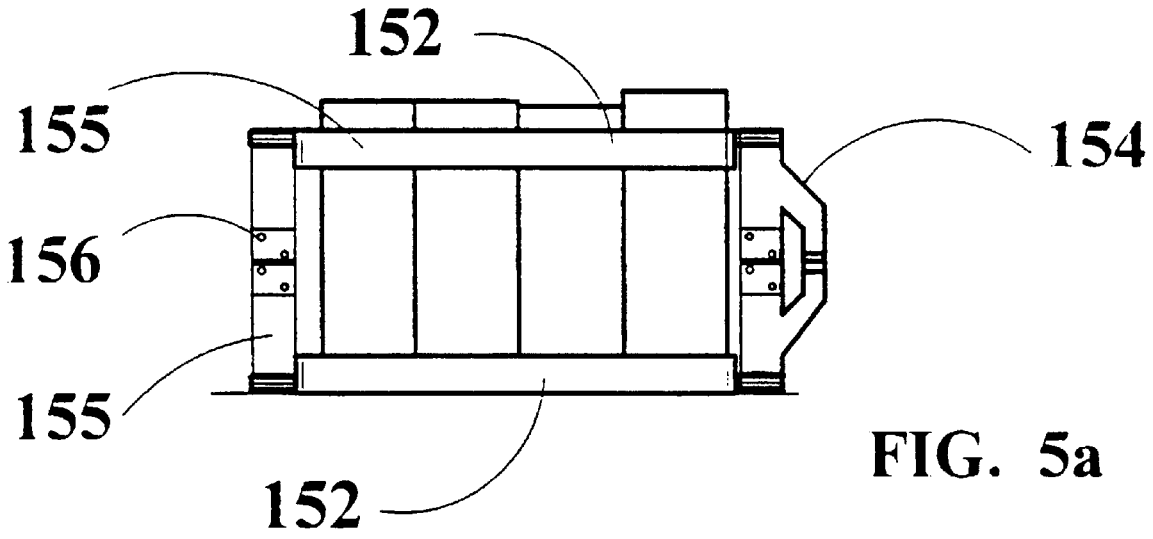
Figure 5B:
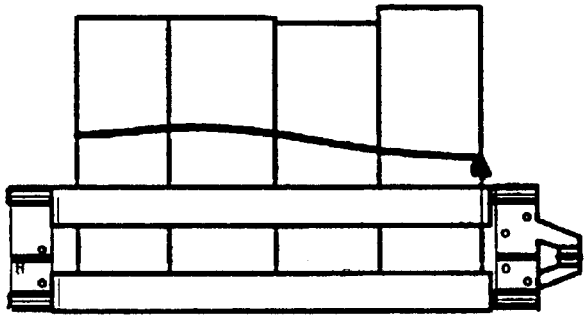
Figure 5C:
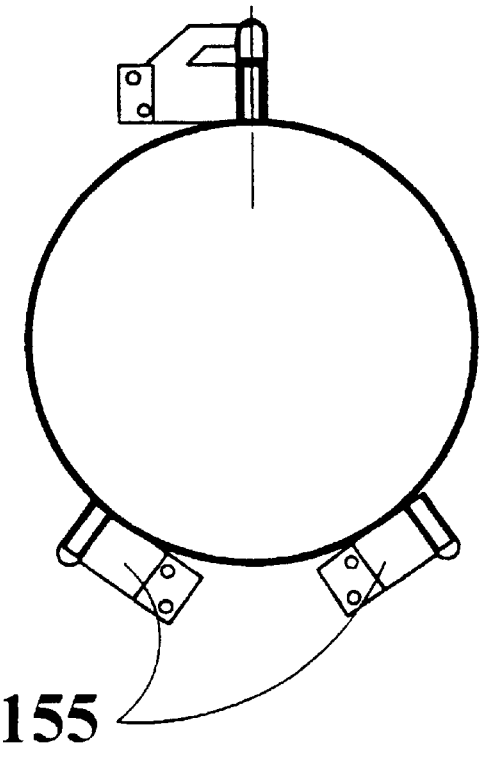
Figure 6A:
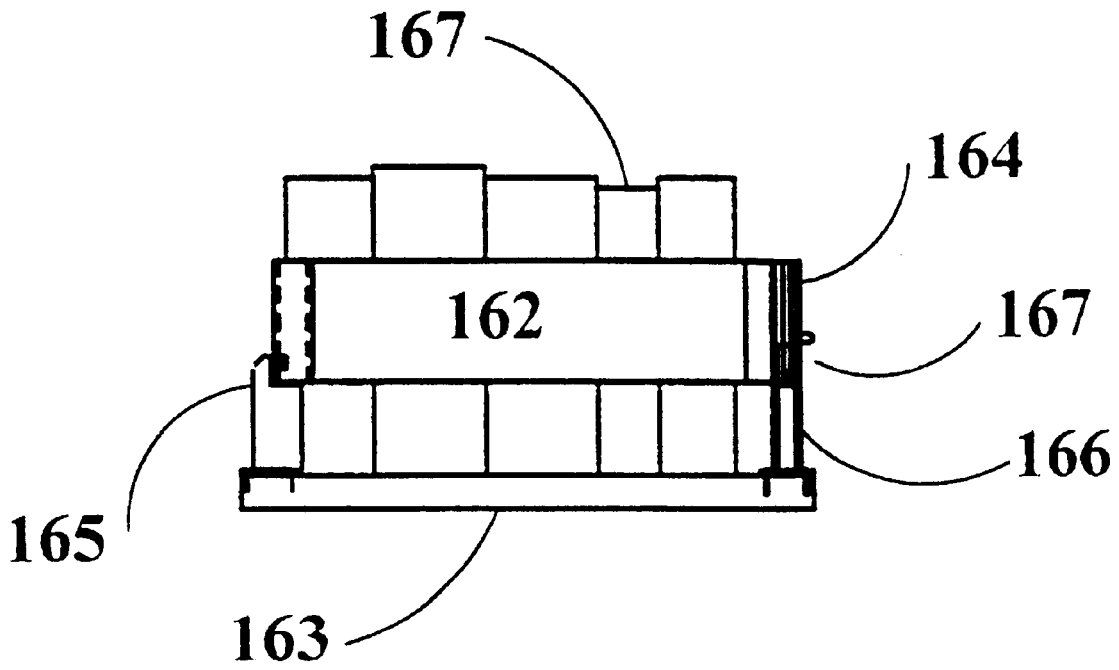
Figure 6B:
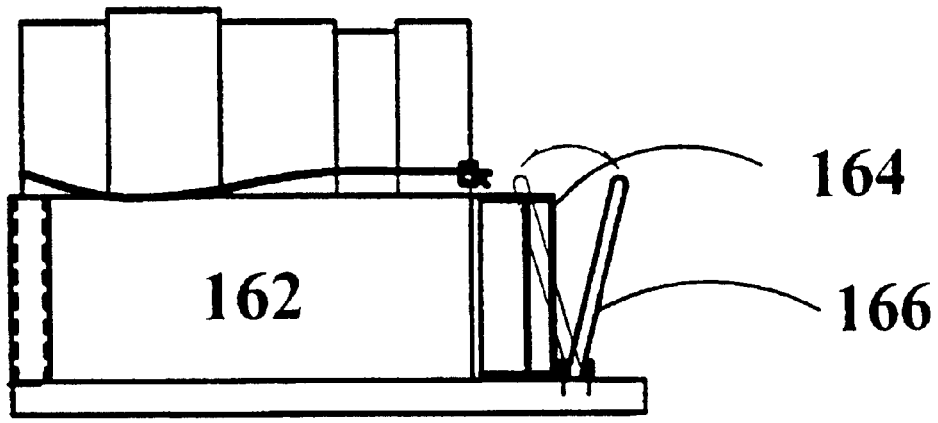
Figure 7A:
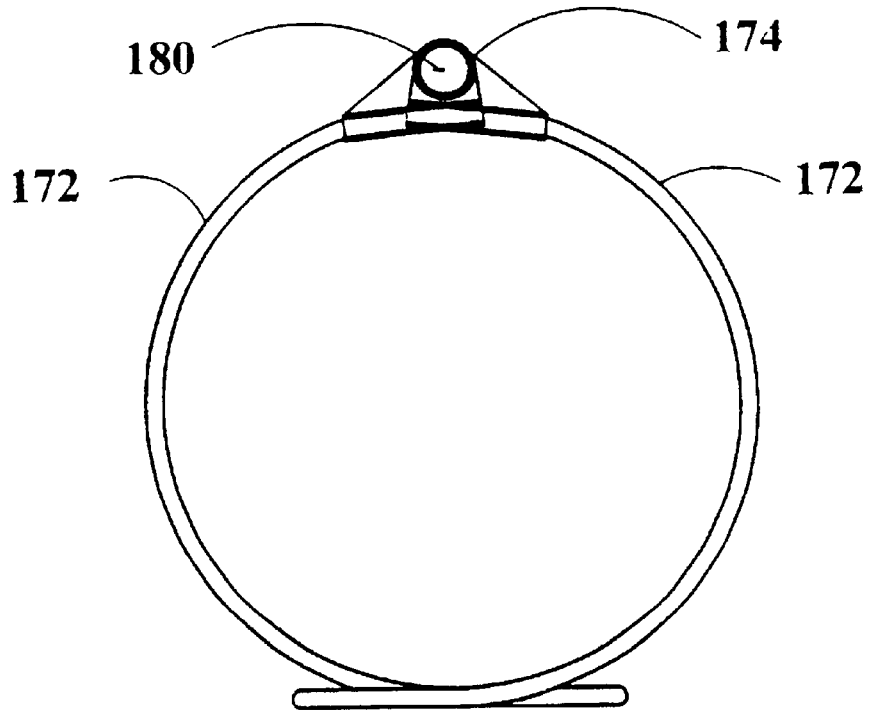
Figure 7B:
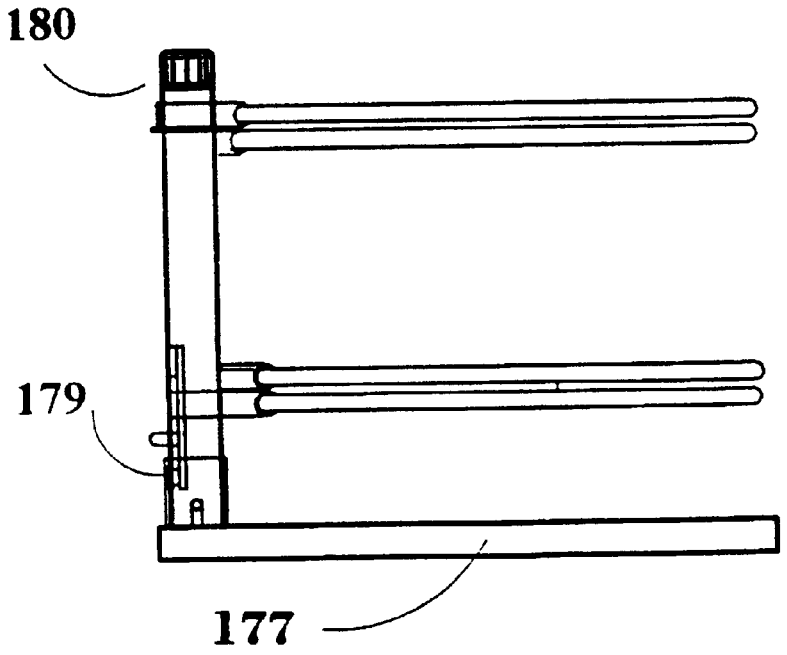
Figure 8A:
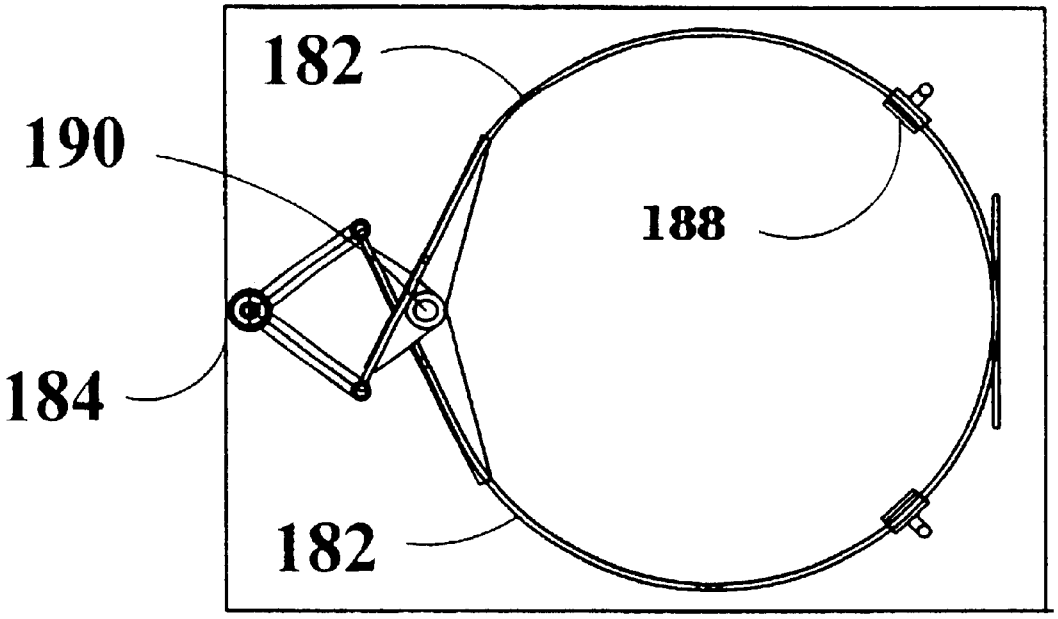
Figure 8B:
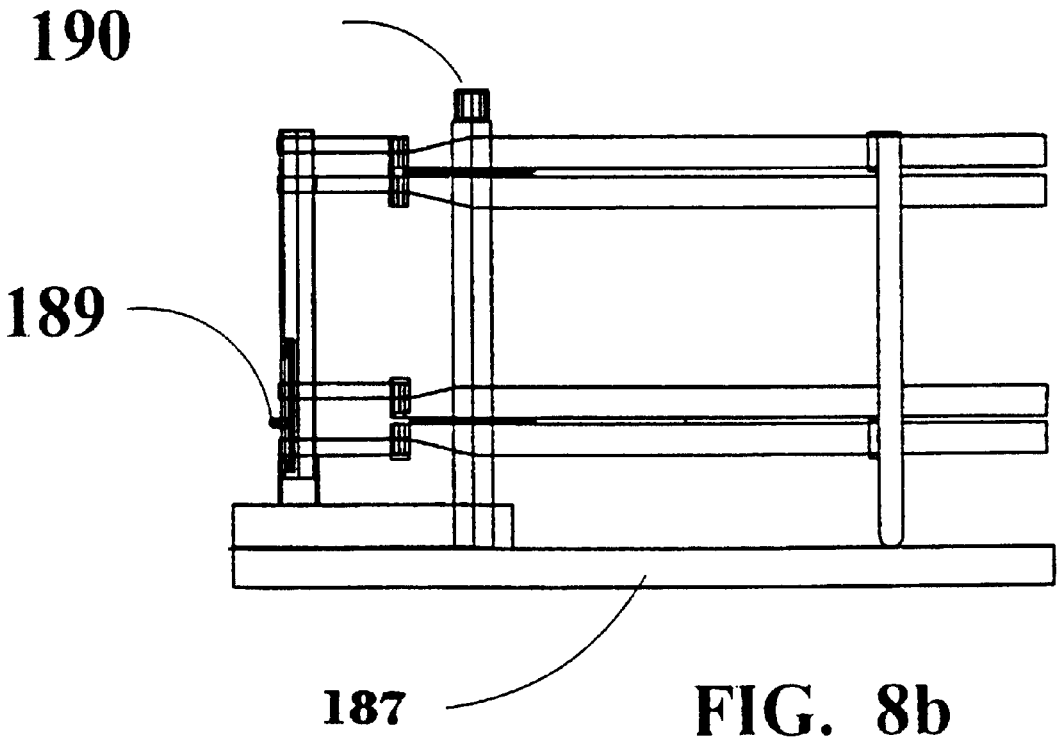
Figure 9:
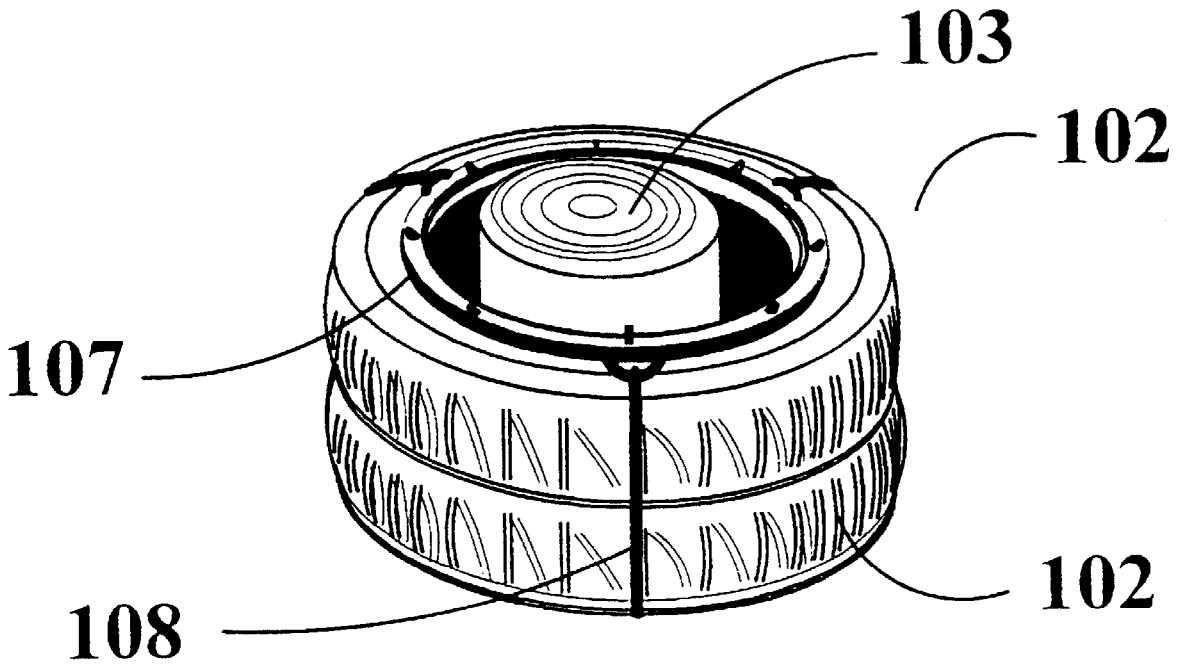

The invention is described in greater detail with reference to the accompanying drawings, in which:

FIGS. 1*a*–1*b* show an embodiment of the accessory according to the invention, seen in two views at right angles to each other;

FIGS. 2*a*–2*d* show a second embodiment of the accessory according to the invention, seen from the side, end, top and correspondingly opened;

FIGS. 3*a*–3*d* show a third embodiment of the device according to the invention, seen from different directions;

FIGS. 4*a*–4*c* show a fourth embodiment of the accessory according to the invention, seen from different directions;

FIGS. 5*a*–5*c* show a fifth embodiment of the accessory according to the invention, seen from different directions;

FIGS. 6*a*–6*b* show yet another embodiment of the accessory of the invention in two different operating situations;

FIGS. 7*a* and 7*b* show the construction of yet another accessory according to the invention, seen from two different directions;

FIGS. 8*a*–8*b* show still a different embodiment of the invention, in the same manner as FIG. 7; and FIG. 9 shows one extremely simplified accessory for splitting wood.

Although the accompanying drawings are referred to in the description of the invention in the following text, they show only one embodiment of the invention, there being numerous possible variations, which nevertheless remain within the scope of the protection of the invention, as described in the claims.

The following description is of an accessory designed to facilitate work especially with an impact-bar type tool for splitting wood. FIGS. 1–9 illustrate the method of working according to the invention. They are only intended as an example of the embodiments of the invention, and as can be clearly seen from the following, only the user's imagination restricts the practical applications of the invention. In addition, it should be noted that the dimensions and other characteristics in the illustrations are not necessarily the same as those used in practice.

FIGS. 1*a* and 1*b* show two different views of one embodiment of the invention. The device comprises ring 102, with the logs 103 for splitting gathered inside to loosely fill ring 102, providing sufficient space to allow further logs to be split, even when those already split expand. The logs can be placed inside the ring 102, when it is on its side on the ground, or when it is vertical. Once the ring is full, a suitable tensioning band 104, or several of them, can be used to pull the logs as tightly together as possible.

The ring is then turned end-up onto a firm base, when the logs can be chopped with an impact-bar type device. Once splitting is completed, the bands are removed and the split wood can be moved, for example, to a stack from inside the ring, or alternatively, ring 102 can be returned to a vertical position and easily moved directly to a woodpile using handle 105.

If required, the above device can have supports 106, which keep the device firmly in place when it is in a vertical position.

In certain circumstances, it is obviously advantageous if ring 102 can be opened. For example, if its circumference can be increased then decreased, the logs can be easily compacted inside the ring. FIGS. 2*a*–2*d* show side and end views of one embodiment based on this. The ring differs from the above description in that it now comprises rod-like components, divided into two semicircles 122 and 122'. These are jointed at point 124. Handle 125 is set so that one end joins the first semicircle at point 126 and, correspondingly, the other end joins the second semicircle 122' at point 126'. Handle 125 has, for example, a component 127, which, when rotated in one direction, lengthens the handle component, rotation in the opposite direction shortening it. Here, shortening tends to open semicircles 122 and 122', lengthening closing them. Thus, the logs can be relatively firmly compressed inside the ring and chopped using an impact bar when the tightened ring is horizontal.

Handle 125 can also operate so that turning the handle component one-quarter turn, for example, allows the ring to be opened freely to a much larger jaw, as shown in FIG. 2*d*. The logs can then be conveniently dropped out of the ring. The ends of rings 122 and 122' can be straight, as shown, forming a firm base for the ring.

FIGS. 2*b* and 2*c* also show a base section 130 for the device, which can be attached to the structure by lock 129 and also easily detached again by opening the lock. Base 130 provides a suitable even and firm base for splitting the logs.

FIGS. 3*a*–3*d* show a fourth embodiment of the device according to the invention. The figures show a model that can be opened and closed as described above. The ring is formed of ring halves 132, 132', jointed around point 135. Locking device 137, which can be of any suitable type, holds the halves together when desired.

A special feature of this model are the feet 136 attached particularly to transverse pipe components 138, 138, which, when the device is turned sidewise for log splitting, act as a base. Another feature is that handle 134 is located at the end of a looped component 139, when the outermost point of loop 139 forms a third support point. In this embodiment too, suitable bands can be used to hold the logs firmly, as in FIG. 3*b*.

FIGS. 4*a*–4*b* show yet another embodiment of a device according to the invention. This differs from the previous embodiment in that it has two rings 142 and 142' connected by a rod 143, which is advantageously permanently attached to the upper ring 142 of the device when it is on its side and is inserted in hole 145 in the lower ring, permitting easy removal. If the lower end of the rod and the corresponding hole are angular in shape, rod 143 can be advantageously prevented from rotating about its axis.

When both rings are in place and joined by rod 143, the above device can be loaded with logs. After loading, binding loop 146 is advantageously used to tighten the logs in place, as described in the other above embodiments. The logs are split using an impact bar, after which the bundle of split wood, bound with the same or another loop, is left inside the loop to rest on the lower ring 142' by lifting off upper ring 142 and rod 143. Handles 144, 144' are provided for lifting. Ring 142 and rod 143 can be removed easily, because rod 143, which is quite thin and smooth, creates little resistance, though the logs are slightly compressed. Further, free space for the rod is made by a loop-like rod seat 147, as shown in FIG. 4*b*.

FIG. 4*c* shows an embodiment, where the mutual positions of the two rings 142, 142' differ from the above. Thus, ring 142 can be turned around joint 148 so that when it is wished to remove the bundle of split wood or bind it with band 146, ring 142 can be turned out of the way as described. Connector arm 143 is best permanently attached to the outer surface of lower ring 142'.

FIGS. 5*a*–5*c* show one way of releasing the upper ends of the split wood, for removal or binding. Rings 152 and 152' are joined together by "feet" 155, 155' and 154, the latter including a handle component for moving and carrying the device. The legs include hinges 156, around which the feet turn, upper ring 152 dropping a corresponding distance and releasing the upper ends of the logs to be handled as required. The rest of the series of FIGS. 5*a*–5*c* should be self-explanatory.

FIGS. 6*a*–6*b* show a diagram of yet other features of the invention. They show a ring 162, which is now set on a base plate 163, with a handle 166 or a corresponding component on one side, and with protrusions 165, so that ring 162 rests on the protrusions 165. As shown, the ring itself may include a handle 164, to facilitate handling. The logs 167 can now be loaded into the ring and split there. Afterwards, ring 162 can be lowered by any means whatever onto the surface of the plate, as shown in FIG. 6*b*, the logs now being easy to remove or bind.

A suitable system for lowering the ring can be constructed, preferably one that is in some way telescopic. The device is then locked into the upper position in a simple manner and released to the lower position for transportation.

A device according to the invention requires a suitable base for splitting. For example, the base may be made of a plate-like material, such as shuttering plywood, and set on a firm foundation. Such a base can stand, for example, on top of concrete slabs. One detail that facilitates work is to make the base considerably larger than the ring and give the edge facing the operator a handle-like grip, so that after splitting, the plate is turned to a vertical position by gripping the handle, when the device also rises to a vertical position and can be easily removed by gripping its handle.

The base can also be provided with suitable devices to retain a ring placed on it. For example, these may be depressions in the plate. The intention is that when the device is turned on its side on top of the plate, the parts supporting the device on the base drop into the depressions and hold the device in place. Other types of "stop" for retaining the device in the required position can also be easily installed on the plate.

FIGS. 7*a* and 7*b* show an accessory with the same general construction as that in FIG. 2, with the addition that handle 174 now has a locking device 180, which may be a screw-type knob, connected to it, to lock the half rings 172 and 172' immovably when tightened. This essentially ensures rigidity when splitting logs, which can be released from the ring by loosening locking device 180. FIG. 7*b* also shows a base 177, which can be attached to, or released from the ring construction by lock 179.

FIGS. 8*a* and 8*b* show yet another variation of the above constructions. Here handle 184 is placed at the outside corner of a jointed parallelogram formed by extensions of rings 182 and 182'. This forms a construction tending to bring rings 182 and 182' closer together, when lifted by handle 184. In this embodiment too, locking device 190 can be used to lock the rings in a certain position. Similarly, base plate 187 and locking/release device 189 can be added to the construction. Reference number 188 shows a rail joining the adjacent rings, and also forming one point of support for the device as shown. In many cases the material of the device according to the invention is a metal tube. This will give the possibility to add some accessory device, e.g. a detachable base plate, using the hollow tubes and a corresponding pin to join two parts together.

The best material for making a structure according to the invention is sheet metal, or metal in the form of a bar or tube, or a combination of these. However, many grades of plastic, for example, are sufficiently durable for the purpose described, allowing parts of devices, or entire devices to be made from plastics-based materials. At least some of the devices can include wooden parts. The choice of material is not critical.

The invention can be varied in many ways, without deviating from the scope of its protection. For example, a device according to the invention can be used to carry logs directly to where they will be burned, such as a fireplace or similar. For this kind of use, a permanent or detachable plate-like component, which fits the ring snugly and prevents debris from dropping onto the area beneath the device, may be attached to those parts of the ring that are lowest when the ring is vertical. Alternatively a separate plate-like component may be located near the fireplace and the device according to the invention may be inserted on the plate.

Further, it is easy to make an accessory according to the invention flexible, so that the two halves composing a ring are, to a limited extent, flexible in relation to each other. In practice, this helps ensure that logs split inside the ring still have sufficient space after splitting. Similarly, because an impact tool is, at least occasionally, struck nearly to the base, the ring's dimensional flexibility provides the tool with the necessary space at all times.

Widely differing devices can be used to open and shut a device according to the invention. Tens of such hinge and locking devices are known in various technical fields.

It is obvious that the shape of the ring is of little consequence. The ring can be made round or nearly round, as described above, but nothing prevents the construction of a hexagonal, square or triangular ring for the purpose described. If wished, the ring can have an extra base, which in certain circumstances can also support the splitting, when the actual base need not be so strong.

The ring of a device according to the invention can be equipped with, for example, hook-like devices in the uppermost edge when it is turned on its side, from which a net "sock" or bag can be suspended, inside which the split logs can be packed and in which they are wrapped after splitting. This produces a neat package, covered by a net or otherwise, which can thus be easily transported and stored.

Even though the most probable construction of the device according to the invention is the one having two halves and the different parts of the halves being welded together, in the case they are made of metal, permanently, also detachable parts jointed together with screws or similar parts may be used when necessary.

FIG. 9 shows how an accessory, according to the invention, for splitting wood can be made in a very simple, cost effective and ecological manner. In this case the accessory device has been made from at least one car or other vehicle tyre 102, 102', inside of which one or more logs 103 to be split can be placed. The figure shows two tyres, placed on top of each other and bound together in a suitable manner. A single wide tyre may suffice, but, depending on the size of the tyres, there may also be several on top of each other. FIG. 9 also shows how the tyres can be easily bound together using a ring 107 with straps 108 attached to it, which conveniently press the tyres together.

When using a device according to the invention, it is easy to work safely, as it is not possible to strike a hand or leg. Work accidents are quite frequent when a conventional axe is used.

What is claimed is:

1. A method of splitting logs using particularly a wedge axe, in which there is an impact bar, characterized in that the logs to be split are loaded into a ring-like device, the ring with the logs inside being set on a firm base with the logs in essentially a vertical position, and splitting taking place by directing the splitting force of the wedge axe onto their ends, wherein the ring with the logs is set for splitting on a plate-like base, the edge of which has a gripping device, for turning the ring from a horizontal position to a vertical position by lifting the edge of the plate.

2. A method according to claim 1, characterized in that the logs inside the ring are additionally tightened in place, prior to splitting, by cord or band-like devices.

3. A method according to claim 1, characterized in that the logs are primarily tightened in place by the force arising from closing a ring (102) comprising two parts.

4. An accessory for splitting logs, particularly using a wedge axe, characterized in that the device comprises two ring components connected detachably on top of each other with the aid of a pin-like component, for holding and supporting the logs during splitting.

5. An accessory according to claim 4, characterized in that the device also contain a plate-like base component detachably jointed to the device.

6. An accessory according to claim 4, characterized in that the ring-like components are formed of two halves (122, 122'; 132, 132'), jointed to each other to permit opening and closing and locking in the closed position.

7. An accessory according to claim 4, characterized in that the upper ring (142, 152) can be turned aside or lowered, to release the upper parts of the logs.

8. An accessory according to claim 7, characterized in that it includes a device (104, 146) for tightening the logs set in it into a tightly packed bundle, prior to splitting.

9. An accessory according to claim 4, characterized in that the ring includes at least one handle (105, 125,134,144,154) for facilitating the handling of the ring and/or carrying it.

10. An accessory according to claim 4, characterized in that the ring (102) also includes support components (106, 136) for supporting it in the desired position, or that the support component is formed by the shaped side of the ring.

11. An accessory according to claim 4, characterized in that the ring (102) contains a protection plate for collecting debris beneath it, when it is vertical.

12. An accessory according to claim 4, characterized in that the ring includes devices for suspending a sock or bag-like support device inside the ring, prior to splitting the logs.

13. An accessory according to claim 4, characterized in that the ring comprises one or more vehicle tires.

14. An accessory for splitting logs, particularly using a wedge axe, characterized in that the device comprises an upper and a lower ring-like component for holding and supporting the logs during splitting and wherein the upper ring is adapted to be turned aside or lowered to release upper parts of the logs.

15. An accessory for splitting logs, particularly using a wedge axe, characterized in that the device comprises at least one ring-like component for holding and supporting the logs during splitting, wherein the ring includes at least one handle for facilitating handling or carrying of the ring.

16. An accessory for splitting logs, particularly using a wedge axe, characterized in that the device comprises at least one ring-like component for holding and supporting the logs during splitting, wherein the ring includes support components for supporting the ring in a desired position.

17. An accessory for splitting logs, particularly using a wedge axe, characterized in that the device comprises at least one ring-like component for holding and supporting the logs during splitting, wherein the ring contains a protection plate for collecting debris beneath the accessory when the accessory is vertical.

18. An accessory for splitting logs, particularly using a wedge axe, characterized in that the device comprises at least one ring-like component for holding and supporting the logs during splitting, wherein the ring includes devices for suspending a sock or bag-like support device inside the ring prior to splitting the logs.

* * * * *